US006825813B2

(12) United States Patent
Pecora, Jr. et al.

(10) Patent No.: US 6,825,813 B2
(45) Date of Patent: Nov. 30, 2004

(54) DEFORMABLE ANTENNA ASSEMBLY FOR MOUNTING IN GAPS AND CREVICES

(75) Inventors: Ronald A. Pecora, Jr., East Falmouth, MA (US); Eugene C. Cullie, Franklin, MA (US)

(73) Assignee: ADS Corporation, Huntsville, AL (US)

( * ) Notice: Subject to any disclaimer, the term of this patent is extended or adjusted under 35 U.S.C. 154(b) by 6 days.

(21) Appl. No.: 10/359,703

(22) Filed: Feb. 7, 2003

(65) Prior Publication Data

US 2004/0155826 A1 Aug. 12, 2004

(51) Int. Cl.[7] ..... H01Q 1/04
(52) U.S. Cl. ..... 343/719; 343/793
(58) Field of Search ..... 343/872, 793, 343/873, 904–906, 702, 719, 795, 893, 897

(56) References Cited

U.S. PATENT DOCUMENTS

| | | | | |
|---|---|---|---|---|
| 4,769,656 A | | 9/1988 | Dickey | 343/718 |
| 5,742,259 A | | 4/1998 | Annamaa | 343/895 |
| 5,877,703 A | | 3/1999 | Bloss, Jr. et al. | 340/870.02 |
| 5,949,384 A | | 9/1999 | Ikushima | 343/866 |
| 6,020,861 A | * | 2/2000 | Jonsson et al. | 343/800 |
| 6,104,355 A | * | 8/2000 | Wilson | 343/749 |
| 6,215,454 B1 | * | 4/2001 | Tran | 343/841 |
| 6,337,663 B1 | | 1/2002 | Chi-Ming | 343/702 |
| 6,501,945 B1 | | 12/2002 | Chien | 455/296 |
| 6,518,933 B2 | * | 2/2003 | Pecora et al. | 343/793 |
| 2002/0180656 A1 | | 12/2002 | Pecora, Jr. et al. | 343/795 |

* cited by examiner

*Primary Examiner*—Thuy Vinh Tran
(74) *Attorney, Agent, or Firm*—Gilberto M. Villacorta; James A. Gromada; Katten Muchin Zavis Rosenman

(57) ABSTRACT

An antenna assembly is formed from at least one antenna and associated conductive connecting element (wires, conductive gel or liquid, etc.) mounted within a deformable membrane that allows the antenna assembly to be installed or fixed within a narrow gap or crevice, wherein the gap or crevice may be subject to harsh environmental conditions. The gap or crevice is preferably a gap or crevice in a closure. The antenna assembly typically has a low profile, and is installed either flush with or within a traffic surface or within ¼" above the surface. The deformable membrane will yield under force, but return to its original shape once the force is removed. The deformable membrane and antenna assembly will deform to conform to the shape of a gap or crevice into which the antenna assembly is installed.

59 Claims, 6 Drawing Sheets

DEFORMABLE ANTENNA ASSEMBLY FOR MOUNTING IN GAPS AND CREVICES

FIELD OF THE INVENTION

The present invention relates generally to antennas. More particularly, the present invention relates to antenna assemblies having a deformable portion that may be fixed within a gap or crevice, particularly a gap or crevice formed between two opposing edges of an closure. Even more particularly, the present invention relates to low profile antennas having a deformable portion for use in roadways, sewer manholes, and other applications where a low profile and a deformable portion are desirable.

BACKGROUND OF THE INVENTION

The collection of data from sanitary or storm sewer networks, air handling systems, and other underground or enclosed systems or networks having access apertures, and/or closures, has become increasingly common and useful. For example, in an underground sewer network, flow monitors may be used to collect data such as depth, volume, velocity, and/or other measurable parameters in a certain location. When such monitors are used, it is often desirable to collect the data in a central location, such as a remote computer or data collection system, so that data from multiple monitors can be analyzed, stored, processed, compared, and/or presented to a user. Because of the impracticality of connecting monitors that may be located throughout such a sewer or other network to a central processor via direct wiring, it is desirable that such monitors transmit their data to a remote computer through a wireless communications medium.

The application of wireless technology to transmit and/or receive data from and/or deliver data to flow monitors within enclosed systems requires a suitable antenna for reception and/or transmission. Typically, the monitors are installed in the interior of enclosed systems or networks near an aperture or closure which provides access to the interior of the enclosed system or network. For example, sewer flow monitors are typically installed in a sewer network inside or near manholes in order to provide easy access to the monitor for installation, maintenance, and repair. Thus, the monitor may communicate with a remote unit outside the network via a wireless transmitter that is also located near or within the manhole. However, if the transmitter's antenna is mounted so that the antenna is below the manhole's cover, substantial losses in signal strength, such as radio frequency (RF) energy losses, will result from factors such as signal attenuation and the fact that the antenna is mounted below the ground plane.

One solution to the problem of antenna placement is to mount the antenna above the ground, outside of the manhole. However, conventional antennas normally require a mast or pole type of mounting. Thus, conventional antennas have an elevation that renders them undesirable for use in many locations, such as roadways and sidewalks, where vehicular and/or pedestrian traffic will flow. Examples of such antennas may be found in U.S. Pat. No. 5,877,703, to Bloss et al. Such antennas are subject to abuse from, and may be damaged by, roadway traffic, such as cars, trucks, buses, and other vehicles, as the traffic drives over them, directly placing substantial loads on the antenna. Other roadway vehicles such as snowplows can cause even more damage to an antenna that is raised above the roadway.

In addition, many such antenna installations require modification to the manhole cover, such as the drilling of a hole, or cutting a groove in a manhole cover or roadway surface, to connect the above-ground antenna to the underground flow meter, or require positioning the antenna within an existing groove of the roadway surface and affixing the antenna therein with a sealant. An example of the latter method is found in published U.S. Patent Application No. US-2002-0180656-A1, the disclosure of which is incorporated herein by reference. Such holes and grooves are generally large, as they are also used as a means to secure the antenna to the manhole and/or to connect the antenna to equipment below the manhole cover, such installation processes are costly and time-consuming, and the installation of multiple antennae requires multiple installation procedures.

Typical antenna assemblies found in current practice are not suitable for installation within an existing gap or crevice in the outer surface of the enclosed system or network. Such a crevice is found commonly in an aperture or closure which may be opened to provide access to the interior of the enclosed system or network, such as the crevice between a manhole cover and the surround in which the cover is seated during normal traffic use. Typical antenna assemblies are not sufficiently flexible or deformable to resist the stresses placed on an antenna positioned within such a crevice. Apertures into enclosed systems typically have closures, such as a cover that fits closely around its periphery within a surround, and abuts to an inner seating rim or lip of the surround that prevents the cover from falling into, or otherwise penetrating, the enclosed system. A manhole cover, for example, is a heavy iron or steel disk that sits within such a surround. The heavy weight and hard-edged surface of the manhole cover puts a great deal of mechanical stress on an apparatus pinched between the cover and the surround, particularly the inner lip portion of the surround. Since a conventional antenna assembly is not deformable or elastic, a conventional antenna assembly cannot resist this stress when the cover is removed from or inserted into the surround, and will tend to break under the stress. Furthermore, conventional antenna assemblies are not suitable for the harsh environmental conditions often found around apertures into, or closures of, enclosed systems, such as the street environment around manhole covers.

Elan Industries, Inc., Hickory Hills, Ill. (www.elanindustries.com), discloses a copolymer manhole cover that includes an integral antenna and cable. This application requires retrofitting an existing manhole with the new cover. Hence, the Elan product requires that the size and shape of a manhole be known in advance of using the device. Since the existing manhole cover is replaced, this process is wasteful. As the antenna is not separable from the manhole cover, another new manhole cover must be employed, or the old cover must be saved and stored, if the antenna is to be removed from the manhole. Furthermore, the Elan product is not readily deformable to fit the variety of gap and crevice sizes and shapes that is found in the field; it must be custom-fabricated for each application. Elan does not disclose an antenna assembly that may be fixed in a gap or crevice that is not a manhole. The Elan product contains only a single antenna, thus making the installation of multiple antennae potentially complicated and costly.

Antennae, and antenna assemblies, having some degree of flexibility can be found in the patent literature. For example, U.S. Pat. No. 4,769,656 discloses an expansion band antenna formed of a woven conductive material that may expand and contract. U.S. Pat. No. 5,742,259 discloses a helical wire antenna that is flexible with respect to its long axis as a spring. U.S. Pat. No. 5,949,384 discloses an antenna apparatus having a wire loop within an elastic sheath that may be collapsed into smaller loops. U.S. Pat. No. 6,337,663 discloses a rigid printed circuit antenna having an elastic connector for connecting with the main board of a communication device. Finally, U.S. Pat. No. 6,501,945 discloses a cellular phone having an antenna assembly that includes an elastic conductor that makes electrical contact between a circuit board and a metallic coating on the interior of the phone to provide an insulating envelope. However, none of these antennae and antenna assemblies has the durability, deformability, and elastic qualities required for the application of providing an antenna assembly that may be installed in a crevice of an aperture into, or closure of, an enclosed system or network, which requires flexibility and deformability in multiple dimensions, impact resistance, weather resistance, and resistance to high mechanical stresses.

Accordingly, it is desirable to provide an improved antenna assembly, as disclosed herein, that overcomes the aforementioned disabilities.

SUMMARY OF THE INVENTION

It is therefore an object of the present invention to provide an improved antenna assembly for mounting in a gap or crevice, particularly a gap or crevice of an openably closed aperture or closure wherein the antenna assembly is flush with or slightly raised above one side of the aperture or closure, preferably the outside, and is connected to transmission lines disposed on the opposite side of the openably closed aperture or closure, preferably the inside.

Another object of the invention is to provide an antenna assembly for mounting between bricks or stones in masonry, or in a groove cut into a solid surface, preferably wherein the antenna assembly is flush with of slightly raised above one side of the masonry or solid surface, preferably the outside, and is connected to transmission lines disposed on the opposite side of the masonry or solid surface, preferably the inside.

An additional object of the invention is to provide an antenna assembly having at least one deformable antenna connected to at least one transmission line by at least one deformable conducting means, wherein the at least one deformable conducting means and/or at least one deformable antenna is suitable for being fixed within a gap or crevice, particularly a gap or crevice of a closure.

It is an additional object of the present invention to provide an antenna having a profile that reduces or eliminates the susceptibility for damage to the antenna resulting from persons or objects passing by the antenna, such as pedestrians, maintenance workers, roadway traffic and road-scraping implements such as snow plows, and the like, and that is deformable to reduce or eliminate the susceptibility for damage from the stresses resulting from the antenna assembly's installation within a within a gap or crevice, particularly a gap or crevice of a closure.

It is another additional object of the present invention to provide an antenna having a profile that reduces or eliminates the risk of injury to pedestrians who might come into contact with the antenna (i.e., by tripping over it, bumping into it, becoming caught upon it, etc.). The height that is of a low profile is preferably about one-fourth of an inch or less, or even more preferably is flush with the mounting surface.

An even further object of the invention is to provide an antenna that is inconspicuous so as to be resistant to vandalism.

Another object of the invention is to provide an antenna assembly having multiple antennae, or multiple antenna subunits, within a single enclosure in order to provide an easy and cost-effective means of installing multiple antennae in one location.

In accordance with a preferred embodiment of the present invention, the present invention provides an antenna assembly, including: at least one antenna; at least one transmission line; at least one conductor for conductively connecting the at least one antenna to the at least one transmission line, wherein the at least one conductor is deformable; and a deformable membrane made from substantially non-conducting material, wherein the deformable membrane substantially encloses the at least one antenna and the at least one conductor, and at least partially encloses the at least one transmission line. The height that is of a low profile is preferably about one-fourth of an inch or less, or even more preferably flush with the mounting surface. The at least one antenna is most preferably deformable, as well.

In accordance with another preferred embodiment of the present invention, the present invention provides an antenna assembly, including: at least one communication means for sending and receiving radio frequency (RF) signals; at least one transmission means for transporting electrical signals; conductive means for conductively connecting the at least one communication means and the at least one transmission means, wherein the conductive means is deformable; and insulating means substantially enclosing the at least one communication means and the conductive means, and at least partially enclosing the at least one transmission means, wherein the insulating means is deformable. The antenna means is preferably deformable and has a low profile. The height that is of a low profile is preferably about one-fourth of an inch or less, or even more preferably flush with the mounting surface.

In the embodiment above, the communication means is preferably at least one antenna, more preferably at least one dipole antenna, and even more preferably at least one dipole antenna having elongated elements with a combined length suitable to provide an antenna electrically tuned to send and/or receive RF signals in close proximity to a traffic surface, as described below. The deformable conductive means is preferably a deformable conductive solid, liquid or gel, and is more preferably a deformable copper wire or ribbon, as described below. The at least one transmission means is preferably at least one transmission line, and more preferably at least one coaxial cable, as described below. The deformable insulating means is preferably a deformable rubber or plastic outer protective covering, as described below.

In a preferred embodiment, at least one antenna of the antenna assembly of the present invention is a low profile dipole antenna for receiving and/or transmitting radio frequencies that includes a first elongated element made from an electrically conductive material, a second elongated element made from the electrically conductive material, and a transmission line that is conductively attached to the first and second elongated elements by way of a conductor. The first and second elongated elements each have a height that is of a low profile and lengths that are substantially equal. Each of these elements is preferably deformable. The elongated elements are covered at least partially with a substantially non-conductive covering that is at least partially deformable.

Optionally and preferably, the first elongated element and the second elongated element are positioned to extend in opposite directions, form substantially a straight line, and are separated by a gap to provide a dipole antenna. Also optionally, the first elongated element and the second elongated element are sized wherein the substantially straight line has a length that corresponds to an operating frequency band of the at least one antenna and wherein the length provides an electrically tuned antenna that is configured to transmit and receive RF signals in close proximity to a surface.

In an alternative embodiment, the antenna assembly of the present invention may include at least one dipole antenna having first and second elongated elements separated by a gap, wherein the first and second elongated elements are positioned to extend in substantially opposite directions from one another and to form a circumferentially-curving line (i.e., a line corresponding to the circumferential periphery of a rounded cover or surround). In an even more preferred embodiment, the circumferentially-curving line has a length that corresponds to an operating frequency band of the at least one antenna wherein the length provides an electrically tuned antenna that is configured to transmit and receive RF signals in close proximity to a surface.

In accordance with the above-described embodiments, the antenna assembly includes at least one conductor, wherein the at least one conductor comprises a conductive solid material. Alternatively, the at least one conductor may comprise a conductive gel material, or even a conductive liquid material. A conductive gel or liquid material is preferably a gel or liquid containing conductive polymers, organic or inorganic salts, and/or metallic particles. A conductive solid material preferably includes a conductive metallic component. A solid conductor preferably includes copper, and may include a copper wire or ribbon. The conductive wire or ribbon may be coiled, repetitively folded, woven, mesh-shaped, have an undulating shape, or may have any other shape that provides flexibility, extensibility, deformability, and resistance to mechanical stresses, particularly stresses of extension and compression.

In a preferred embodiment, the antenna assembly has a substantially non-conductive covering that is preferably at least partially deformable. The substantially non-conductive membrane is preferably comprised of at least one of rubber, plastic, non-metallic tubing, an adhesive, or a non-metallic substrate. In a preferred embodiment, the antenna assembly has a deformable membrane, wherein the deformable membrane has a substantially flat body having a base edge and a crest edge opposite to the base edge, wherein the at least one transmission line emerges from the base edge of the deformable membrane, the at least one deformable conductor is disposed within the body of the deformable membrane, and the at least one dipole antenna is at least partially enclosed within the crest edge of the deformable membrane. Even more preferably, the crest edge has a thicker cross section than the body of the deformable membrane. The body of the deformable membrane may be at least partially coated on at least one side with an adhesive substance. The at least one antenna is, preferably, deformable.

In another preferred embodiment of the invention, the antenna assembly is mounted between bricks or stones in masonry, or in a groove cut into a solid surface. In a more preferred embodiment, an antenna assembly as described above is mounted or fixed between bricks or stones in masonry or in a groove cut into a solid surface with at least a portion of the deformable membrane fixed between opposing edges of the bricks, stones, or groove, and with the at least one transmission line behind the solid surface. In an even more preferred embodiment, the antenna assembly as described above has a crest portion that is disposed flush with or no more than about ¼ inch in front of the solid surface.

In another alternative embodiment, the antenna assembly has a deformable membrane, wherein at least part of the deformable membrane is ring-shaped and is sized to elastically encircle a periphery of a cover that fits into a surround. The size of the ring-shaped portion may be equal to or smaller than the circumference of the cover, and when the size is smaller, the contractile force of an elastic deformation required to stretch the ring-shaped portion around the outer periphery of the cover provides sufficient force to secure the antenna assembly to the cover. In a preferred embodiment, the cover is a traffic surface cover. In an even more preferred embodiment, the cover is a manhole cover and the surround is a manhole ring. The ring shaped portion of the deformable membrane may be at least partially coated on at least one side with an adhesive substance.

The at least one transmission line may also be connected to a transmitter or receiver or transceiver. Optionally, the antenna assembly includes an adhesive material that is affixed to at least a portion of the substantially non-conductive membrane. In an embedded or flush application, the antenna may be fixed to and sealed within the mounting surface by epoxy formulations specialized for sealing the type of surface the antenna is being positioned on or within. An antenna assembly of the present invention may be removably or permanently fixed to the mounting surface. When permanently fixed to the mounting surface, the antenna assembly may be at least partially embedded in a permanent adhesive that fills a gap or crevice into which the antenna assembly is at least partially inserted.

In another embodiment, the present invention provides an antenna assembly as described above or below further comprising at least one transceiver. In preferred embodiments, the at least one transceiver is substantially enclosed within the deformable membrane. In more preferred embodiments, the at least one transceiver is conductively connected to the at least one antenna of the antenna assembly.

The present invention is also directed to methods of installing an antenna assembly in a crevice or gap, particularly in a crevice or gap of an aperture or in a crevice of an aperture closure, or in a crevice of a closure. In one embodiment, the present invention provides a method of installing an antenna assembly in a closure, comprising: opening the closure sufficiently to provide a gap; disposing within the gap at least a portion of an antenna assembly, the antenna assembly; and closing the aperture to fix the antenna assembly in place. The antenna assembly may be an antenna assembly as described above or below. In this embodiment, the at least one antenna is preferably deformable.

In another embodiment, an antenna assembly as described above or below is fixed in a solid surface by a method comprising cutting a groove into a solid surface and fixing at least a portion of an antenna assembly within the groove. In another embodiment, an antenna assembly as described above or below is fixed in a solid surface during construction of the solid surface. In particular, during the laying of masonry (i.e., stones, bricks, cinderblocks, or the like), at least a portion of an antenna assembly is disposed between adjacent masonry units, is fixed in place with mortar or other adhesive, and becomes a permanent fixture in the masonry. Even more preferably, the at least one transmission line emerges from one side of the masonry, preferably the inside or behind the masonry. Most preferably, the antenna assembly comprises a crest edge that is disposed about flush with and no more than about ¼ inch in front of the masonry.

The present invention also provides a method of installing or fixing an antenna assembly in a traffic surface, comprising: providing a traffic surface comprising a cover and a surround adapted to receive the cover in an orientation substantially flush with the traffic surface; removing the cover from within the surround; disposing adjacent to at least a portion of an inner periphery of the surround at least a portion of an antenna assembly as described above or below; and replacing the cover within the surround such that the at least a portion of the antenna assembly is fixed between at least a portion of the cover and the at least a portion of the inner periphery of the surround. In an alternative embodiment, a gap or crevice is formed between especially tight-fitting cover and surrounds, for example by grinding away a portion of the outer periphery of the cover or the inner periphery of the surround, in order that an antenna assembly of the present invention may be disposed therethrough.

The present invention also provides a method of installing or fixing an antenna assembly in a traffic surface, comprising: providing a traffic surface comprising a cover and a surround adapted to receive the cover in an orientation substantially flush with the traffic surface; removing the cover from within the surround; adhering at least a portion of an antenna assembly, as described above or below, but wherein the deformable membrane is at least partially coated on at least one side with an adhesive substance, to either at least a portion of an outer periphery of the cover or at least a portion of an inner periphery of the surround; and replacing the cover within the surround such that the at least a portion of the antenna assembly is sandwiched between at least a portion of the cover and at least a portion of the inner periphery of the surround.

The present invention further provides a method of installing or fixing an antenna assembly in a traffic surface, comprising: providing a traffic surface comprising a cover and a surround adapted to receive the cover in an orientation substantially flush with the traffic surface; disposing adjacent to at least a portion of an inner periphery of the surround at least a portion of an antenna assembly, the antenna assembly comprising: at least one antenna; at least one transmission line; at least one conductor for conductively connecting the at least one antenna to the at least one transmission line, wherein the at least one conductor is deformable; and a deformable membrane made from substantially non-conducting material substantially covering the at least one antenna and the at least one conductor, and at least partially enclosing the at least one transmission line; wherein the deformable membrane has a substantially flat body having a base edge and a crest edge opposite to the base edge; wherein the at least one transmission line emerges from the base edge of the deformable membrane, the at least one conductor is disposed within the body of the deformable membrane, and the at least one antenna is at least partially enclosed within the crest edge of the deformable membrane; and wherein the crest edge has a thicker cross section than the body of the deformable membrane; so that the crest edge is disposed above the traffic surface but no more than about ¼ inch above the traffic surface, at least a portion of the body of the deformable membrane is disposed across the inner periphery of the surround, and the at least one cable extends below the surround; and replacing the cover within the surround such that the at least a portion of the body of the deformable membrane is clamped between at least a portion of the outer periphery of the cover and the at least a portion of the inner periphery of the surround, and such that the crest edge is disposed above, but not more than about ¼ inch above, the traffic surface, and the at least one cable extends below the traffic surface. Prior to replacing the cover, the at least one transmission line may be connected to a transceiver or other instrument disposed below the traffic surface.

In a more preferred embodiment, the present invention provides a method of installing or fixing an antenna assembly in a traffic surface, comprising: providing a traffic surface comprising a cover and a surround adapted to receive the cover in an orientation substantially flush with the traffic surface; providing an antenna assembly as described above or below, but wherein the body of the deformable membrane is at least partially coated on at least one side with an adhesive substance; adhering at least a portion of the body of the deformable membrane of the antenna assembly to at least a portion of an outer periphery of the cover or an inner periphery of the surround so that the crest edge is disposed above the traffic surface but no more than about ¼ inch above the traffic surface, the at least a portion of the body of the deformable membrane is disposed across the outer periphery of the cover or the inner periphery of the surround, and the at least one transmission line extends below the cover or surround, and replacing the cover within the surround such that the at least a portion of the body of the deformable membrane is fixed between the at least a portion of the outer periphery of the cover and at least a portion of the inner periphery of the surround or the at least a portion of the inner periphery of the surround and at least a portion of the outer periphery of the cover, such that the crest edge is disposed above, but not more than about ¼ inch above, the traffic surface, and the at least one cable extends below the traffic surface. Prior to replacing the cover, the at least one transmission line may be connected to a transceiver or other instrument disposed below the traffic surface.

Alternate embodiments of the present invention, as described above, provide methods of installing or fixing an antenna assembly in a traffic surface wherein at least part of the deformable membrane of the antenna assembly is ring shaped and is sized to elastically encircle the periphery of the traffic surface cover, and wherein the body of the deformable membrane may be at least partially coated on at least one side with an adhesive substance; and wherein at least a portion of the antenna assembly is disposed around or adhered to an outer periphery of the cover. In such embodiments, the ring-shaped portion of the deformable membrane may act further as a gasket between opposing edges of the cover and surround where the antenna assembly is installed, and may act to seal the aperture against the entry of environmental contaminants. In another such embodiment, the ring-shaped portion of the deformable membrane may be embedded within an adhesive or sealant, either removable or permanent, that at least partially fills the gap or crevice into which the antenna assembly is fixed.

The present invention further provides an apparatus, comprising: a gap in a solid surface having an antenna assembly, as described above or below, removably or permanently fixed within a gap of the solid surface.

The present invention also provides an apparatus, comprising: a closure having an antenna assembly, as described above or below, removably or permanently fixed within a gap of the closure.

In a preferred embodiment, the present invention provides an apparatus, comprising: a traffic surface comprising a cover and a surround adapted to receive the cover in an orientation substantially flush with the traffic surface; and an antenna assembly, as described above or below, removably or permanently fixed between at least part of an outer periphery of the cover and at least part of an inner periphery of the surround.

In an even more preferred embodiment, the present invention provides an apparatus, comprising: a traffic surface, comprising a cover and a surround adapted to receive the cover in an orientation substantially flush with the traffic surface; and an antenna assembly as described above or below removably fixed between at least part of an outer periphery of the cover and at least part of an inner periphery of the surround, wherein the crest edge is disposed above the traffic surface but no more than about ¼ inch above the traffic surface, at least a portion of the body of the deformable membrane is disposed between the at least part of the outer periphery of the cover and the at least part of the inner periphery of the surround, and the at least one transmission line extends below the traffic surface. The at least one transmission line is preferably connected to at least one transceiver or other instrument. Even more preferably, the at least one transceiver or other instrument is below the traffic surface.

Even further, the present invention provides a method for sending and receiving RF signals from within a gap in a solid surface or behind a closure, comprising: providing an antenna assembly, as described in any of the embodiments above or below, fixed within a gap or closure, preferably between opposing edges of the gap or closure; providing at least one RF signal transceiver; connecting conductively the at least one RF signal transceiver to the at least one antenna by conductively connecting the at least one RF signal transceiver to the at least one transmission line; and transmitting or receiving RF signals using the antenna assembly. The transceiver is preferably behind the solid surface or closure, and the antenna assembly preferably has a low profile with respect to the side of the solid surface or closure opposite to the transceiver, i.e., in front of the solid surface or closure.

In a more preferred embodiment, the present invention provides a method for sending and receiving RF signals, comprising: providing an antenna assembly, as described in any of the embodiments above or below, removably fixed to a traffic surface, wherein the traffic surface comprises a cover and a surround adapted to receive the cover in an orientation substantially flush with the traffic surface, between at least part of an outer periphery of the cover and at least part of an inner periphery of the surround; providing at least one RF signal transceiver of other instrument; connecting conductively the at least one RF signal transceiver or other instrument to the at least one antenna by conductively connecting the at least one RF signal transceiver or other instrument to the at least one transmission line; and transmitting or receiving RF signals using the antenna assembly. Preferably, the transceiver or other instrument is situated below the traffic surface.

The present invention may be used favorably in a variety of locations. The antenna assembly of the present invention, as described above or below, may be installed in any gap, crevice, openably closed aperture, or closure. In a preferred embodiment, the antenna assembly of the present invention may be installed in any gap, crevice, aperture, or closure providing access to an enclosed system or network, such as a storm sewer network, sanitary sewer network, or air handling network. Examples of such apertures and closures include apertures and closures in traffic surfaces, such as roadways, sidewalks, decking, floors, and stairways, such apertures and closures including storm sewer gratings, utility access points and manholes and the like, and apertures and closures in other enclosed networks such as ductwork, such apertures and closures including access panels, doors, windows, grills, screens, and the like. In more preferred embodiments of the above, the apertures and closures comprise a cover and a surround, and even more preferably the cover is a manhole cover and the surround is a manhole ring.

In some of the various embodiments of the present invention, the at least one antenna may be a dipole antenna. In preferred embodiments, the antenna assembly of has at least one antenna, wherein the at least one antenna is a dipole antenna and comprises first and second elongated elements separated by a gap, and the first and second elongated elements are positioned to extend in substantially opposite directions from one another and to form a substantially straight line. In more preferred embodiments, the substantially straight line has a length that corresponds to an operating frequency band of the at least one antenna, and the length provides an electrically tuned antenna that is configured to transmit and receive RF signals in close proximity to a surface.

In other of the various embodiments of the present invention, the at least one antenna may be a dipole antenna, wherein the at least one dipole antenna comprises first and second elongated elements separated by a gap, and the first and second elongated elements are positioned to extend in substantially opposite directions from one another and to form a circumferentially-curving line, and wherein the circumferentially-curving line has a length that corresponds to an operating frequency band of the at least one antenna. In even more preferred embodiments, the length provides an electrically tuned antenna that is configured to transmit and receive RF signals in close proximity to a surface.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract included below, are for the purpose of description and should not be regarded as limiting in any way.

As such, those skilled in the art will appreciate that the concept and objectives, upon which this disclosure is based, may be readily used as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF A PREFERRED EMBODIMENT OF THE INVENTION

Figure 1:
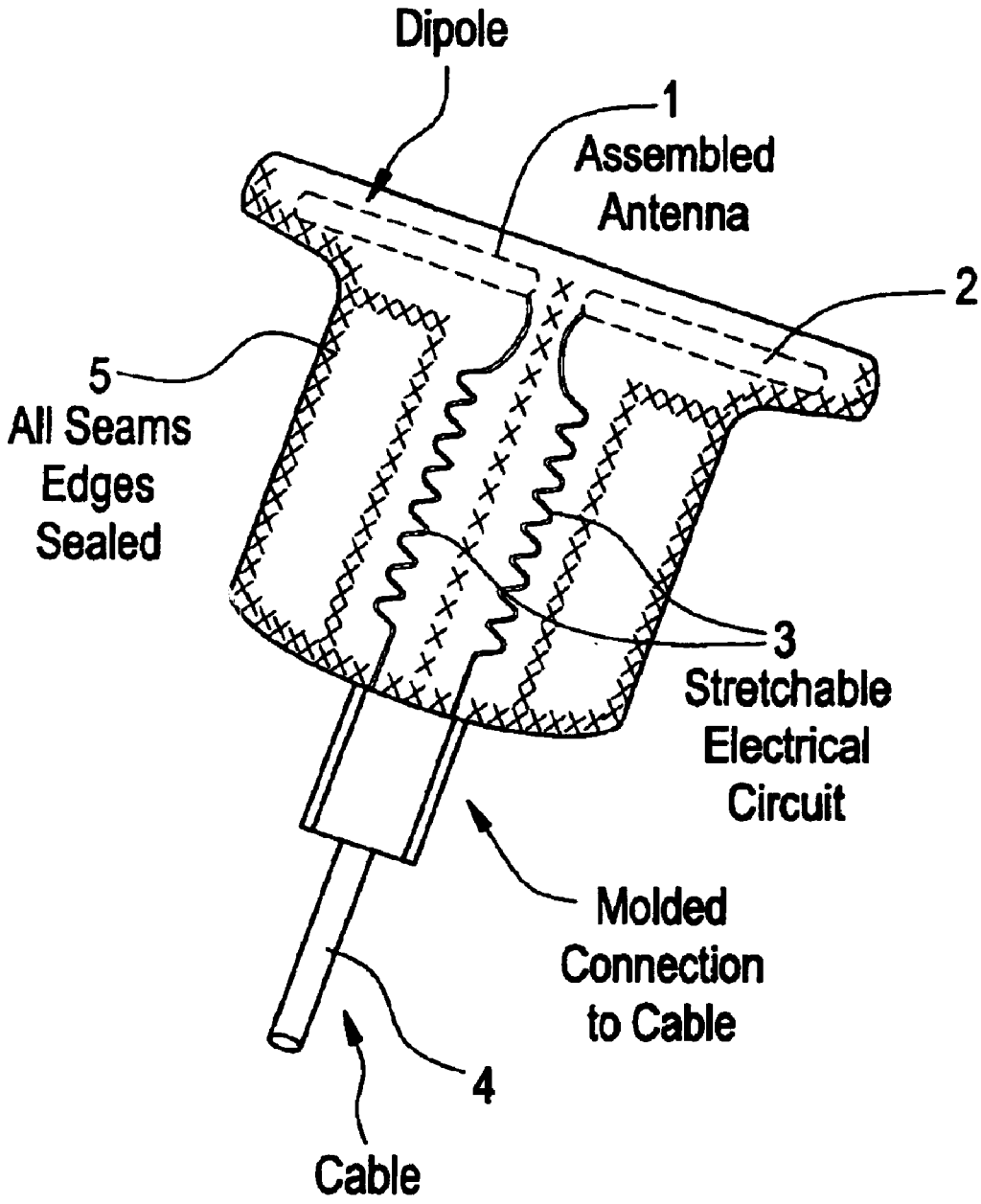
FIG. 1 provides a perspective cut-open view illustrating several elements of a preferred embodiment of the present inventive antenna assembly.

The present invention provides an antenna assembly that is suitable for being fixed in any gap or crevice, particularly a gap or crevice of an openably closed aperture or closure, the at least one antenna of the assembly being deformable and the antenna assembly having a deformable, yet durable and waterproof outer protective membrane. An "aperture" is any means of access from the exterior of a enclosed system or network to the interior of the enclosed system or network. A "closure" is any means of access from the exterior of a enclosed system or network to the interior of the enclosed system or network that may be opened and closed, or openably closed, and may include access panels, storm sewer gratings, manholes, doors, windows, grills, screens, and the like. "Openably closed" means any configuration of an aperture whereby the aperture is closed to prevent access to the interior of the enclosed system or network, but may be opened to allow access to the interior and then closed again. Preferred embodiments of openably closed apertures and closures include manholes with covers, access panels with covers, doors, windows, storm sewer gratings, removable screens and grills, and the like.

An antenna assembly of the present invention may also be fixed in a gap or crevice of any solid surface. "Solid surface" means the surface of any solid medium, but particularly means solid surfaces found in construction, manufacturing, or civil engineering. For example, a solid surface may include a roadway, sidewalk, floor, stair, wall, ceiling, duct, pipe, easement, roof, or the like. The solid surface may be constructed of any building material, including drywall, plaster, cement, cinderblock, brick, stone, asphalt, plastic, wood, ceramic, metal, or the like. A gap or crevice in a solid surface may be a gap or crevice that is formed into the solid surface or one that is inherent in the surface. For example, a gap or crevice may be a groove which is cut into a plaster wall, metal duct, or asphalt roadway. Alternatively, a gap or crevice may be a naturally occurring crack in a rock, split in wood, or may be a joint between building materials, such as the joints between adjacent bricks or stones in masonry. An antenna assembly of the present invention may be fixed into such gaps or crevices in an existing solid surface, for example a groove cut into an existing cinderblock wall, or may be fixed into such a solid surface during its construction. In an example of the latter embodiment, an antenna assembly of the present invention may be laid between adjacent cinderblocks and fixed into place by the mortar used to join the adjacent cinderblocks, thus taking the place of a portion of the grout, cement, or other adhesive used to join the masonry. Most preferably, at least one transmission line of the antenna assembly will be disposed on one side of the solid surface, for example behind or inside a cinderblock construction, and at least one antenna of the antenna assembly will be about flush with and no more than about ¼ inch beyond, outside, or in front of the cinderblock construction.

Apertures and closures typically include one or more covers, or doors, and a surround, into which the cover or door fits closely when the aperture is closed, but may also include iris configurations or other configurations that do not have a single cover piece and surround. Also, typically, such aperture or closure surrounds include an inner lip or stop against which the door or cover rests when the aperture or closure is closed and that prevents the door or cover from entering the interior of the enclosed system. Such apertures and closures typically have opposing edges, where "opposing edges" means any contact surfaces of an aperture or closure that are separated when the aperture or closure is opened, but are in contact or are close to one another when the aperture or closure is closed. Preferably, opposing edges are at least part of the inner periphery of the surround of the aperture or closure and the outer periphery of the cover of the aperture or closure. However, opposing edges of an aperture or closure also includes the contacting portions of the aperture or closure surround inner lip and the lower or inner surface of the aperture or closure cover. In instances where the opposing edges are so close together that an antenna assembly of the present invention may not be otherwise fixed within the gap or crevice between the opposing edges, the opposing edges may be modified to provide a sufficient gap or crevice, for example by cutting or grinding.

In a preferred embodiment, the antenna assembly has a low profile. "Low profile" means that the highest elevation of any portion of the antenna assembly above the aperture surface is about ¼ inch. The low profile allows the antenna assembly to be used in traffic surfaces such as manhole covers in roadways or sidewalks, near irrigation systems, and in other locations where traffic may be present, as the low profile helps to protect the antenna as it is contacted by vehicular and/or pedestrian traffic. "Traffic surface" means any surface which may encounter vehicular or pedestrian traffic, and includes all closures and apertures into and through such surfaces. Preferably, the low profile allows the antenna to rest at or below the primary traffic surface of the roadway or sidewalk in an indentation such as an expansion groove, a groove cut into the surface for mounting the antenna, a manhole cover groove or recess, storm sewer grate, or other similar location, and even more preferably in a gap or crevice between opposing edges of an aperture or closure, or between the cover of an aperture or closure and its surround, and even more preferably between a manhole cover and a manhole ring.

In a preferred embodiment, the antenna assembly includes several elements, including at least one antenna, at least one transmission line, and at least one conductor for conductively connecting the antenna legs to the transmission line. The at least one antenna is capable of transmitting or receiving radio frequency (RF) signals. "Radio frequency," or "RF," means electrical signals or radiation having frequencies in the range of about 9 kilohertz (kHz) to about 300 gigahertz (GHz), preferably about 3 megahertz (MHz) to about 30 GHz, more preferably about 30 MHz to about 30 GHz, and even more preferably from about 300 MHz to about 6 GHz. Whereas it should be understood that an antenna assembly of the present invention may include 1, 2, 3, 4, 5, or any other number of independent or cooperative antenna subunits, for ease of understanding, and with no intent to limit the scope of the present invention, only a single antenna subunit is described.

While it is to be understood that any single antenna subunit may include an antenna of any kind, in a preferred embodiment the antenna is a dipole antenna. The elements of a single dipole antenna subunit include two antenna legs that are partially or completely made of a conductive material, such as copper or another conductive metal, a transmission line, and a conductor for conductively connecting the antenna legs to the transmission line. In a preferred embodiment, the antenna legs are separated by a gap, i.e., the central point from which each antenna leg radiates in opposing directions generally forming a substantially straight line, or substantially circumferentially curved line, depending upon the application. One antenna leg serves the function of a ground, the other is generally referred to as the positive side of the antenna. The legs are positioned in parallel with each other, radiating in opposing directions from a central point. Thus, in a preferred embodiment, the antenna generally follows the electrical and physical principles that are applicable to a half wave dipole antenna.

If the mounting surface is the periphery of a square, rectangle, or other shape having at least one substantially straight side, then the preferred embodiment of the dipole antenna will include legs that radiate from a central point and form substantially a straight line. On the other hand, if the mounting surface is the periphery of a circle, such as a manhole cover or manhole ring, then the preferred embodiment of the dipole antenna will include legs that radiate from a central point and form a substantially circumferentially-curved line.

In a preferred embodiment, the antenna legs are conductively connected to a transceiver via a conductor, such as copper wire, mesh, weave, coil, flattened coil, or ribbon, and a transmission line such as a standard RF coaxial cable or other cable or wire, where the conductor is in direct electrical contact with the antenna legs at one end and with the transmission line at the other end. Preferably, the conductor is conductively connected to the antenna legs at or near the antenna gap, i.e., the central point from which each antenna leg radiates in opposing directions.

The conductive material of the antenna legs and the conductor may be the same or different, but is preferably deformable and may be molded or flattened to have a low profile, such as with a copper wire, a copper weave, a copper mesh, a copper coil or flattened coil, or copper tape. "Deformable" means having the ability to change shape without substantially altering its other physical properties. The conductor may, alternatively, include a conductive gel or a conductive liquid material, each of which has the requisite qualities of deformability and electrical conductance. A conductive gel or liquid material is preferably a gel or liquid containing conductive polymers, organic or inorganic salts, and/or metallic particles. Such conductive gels include, for example, Flowable Oxide gels manufactured by Dow Corning. Most preferably, the connections between the transmission line and conductor, and between the conductor and the antenna subunit, are also flexible and deformable, and not rigid or brittle, thus providing an antenna assembly having optimal deformability throughout.

The deformability of the antennae and conductors, as well as the deformable membrane, allows mounting of the antenna assembly onto a mounting surface that may be either smooth or irregular. For example, the mounting surface could be a groove, recess, or slot of a manhole cover or traffic surface, a storm sewer grate, or any other aperture or closure location. Preferably, the mounting surface is in a crevice between opposing edges of an aperture or closure. Portions of the antenna assembly that are subject to the most mechanical stress are preferably elastically deformable, whereas parts that mounted within a crevice but not subject to substantial mechanical stress are preferably deformable.

The conductor may be led away from the antenna legs in any direction which suits the necessary mounting arrangement. For example, in the case of mounting the antenna on a flat or slightly contoured surface where only the antenna legs are to be exposed, the conductor may be positioned perpendicular to the antenna legs so that it may pass through the crevice in which the antenna assembly is mounted. Optionally and alternately, the conductor may be routed along side the antenna legs until it reaches a suitable position to transition through or off the mounting surface.

The antenna assembly is at least partially enclosed by an outer protective membrane. Preferably, the protective membrane is made of a deformable material and, more preferably, has insulating properties and is durable and waterproof and, even more preferably also has the property of being machinable. "Deformable" means having the ability to change shape without substantially altering its other physical properties. Deformable includes "elastically deformable," which means having the ability to be stretched or compressed and then to rebound to about the same shape and size possessed prior to the stretching or compression. Deformable may also mean that the material is deformable during the manufacturing process, but becomes rigid or is made rigid for a particular application. "Insulating" means electrically insulating, but more preferably may mean insulating with respect to temperature, pressure, and/or other environmental stresses. "Waterproof" means being impermeable to water, solvents, salts and other common such materials. "Durable" means being resistant to mechanical stresses, such as the stress of being run over by a motor vehicle, or more preferably the stress of being pinched between heavy, hard edged metal objects such as a manhole cover and its surround. More preferably, "durable" also means resistant to chemical stresses as well, for example being exposed to strong acids or bases. Optionally and preferably, the antenna legs, conductor, and transmission line are each partially, substantially, or entirely enclosed within the protective membrane. "Substantially enclosed" means at least 50% enclosed. Even more preferably, the entire antenna assembly is waterproof, and may be submerged in water or other liquids without being damaged.

The protective membrane helps to improve the durability of the antenna subunits, conductors, and transmission lines, and to protect them before and after mounting. The protective membrane is substantially, and preferably completely, non-conductive so that the protective covering does not interfere with the operation of the antenna. For example, the protective membrane may be made of rubber, plastic or other non-conductive material. This protective membrane may be in the form of a sleeve, encapsulate, sheet, or any other form. In addition, the protective membrane may be attached to, or even replaced by a substrate such as a non-metallic semiconductor or circuit board substrate. The protective membrane helps to reduce the risk of damage to the conductive elements during handling, transport, and installation of the antenna.

Additionally, in a preferred embodiment, the antenna assembly may include an adhesive coating over all, or only a portion, of the protective membrane that serves to fixedly or removably attach the antenna assembly to a mounting surface. Suitable adhesives may include gums, glues, epoxies, magnets, or fabric adhesives, but preferably the adhesive is not permanent and allows the antenna assembly to be removed from the mounting surface. Preferably, the adhesive coating is only on one side of the protective membrane so as to prevent the antenna assembly from causing the aperture to become stuck closed. However, in some embodiments it is preferred that the antenna assembly aid in keeping the aperture closed or in sealing the aperture against water, air, or other elements. In such an embodiment, it is preferred that the adhesive coating be on both sides of the protective membrane, and/or that the antenna assembly is at least partially embedded within an adhesive, such as an epoxy, that at least partially, and preferably totally, fills the gap or crevice where the antenna assembly is installed.

In a more preferred embodiment, the deformable membrane has a substantially flat body having a base edge and a crest edge opposite to the base edge, wherein the at least one transmission line emerges from the base edge of the deformable membrane, the at least one conductor is disposed within the body of the deformable membrane, and the at least one dipole antenna is at least partially enclosed within the crest edge of the deformable membrane. When mounted, the crest edge is about flush with the outer surface of the aperture or closure and the body of the membrane is at least partially disposed within the crevice between opposing edges of the aperture or closure cover. Thus, the majority of the mechanical stress caused by the installation process and mounting location is borne by the body portion of the membrane that encloses the conductor. The greatest mechanical stresses will likely be encountered by a portion of the antenna assembly pinched between a portion of the outer periphery of the cover and a portion of the inner lip of the surround. Most preferably, a deformable portion of the body of the membrane will bear this stress.

Most preferably, the crest edge of the membrane has a thicker cross section than the body of the deformable membrane. When mounted, the crest edge of this embodiment is about flush with but raised just above the outer surface of the aperture or closure, maintaining a low profile, while the body of the membrane is at least partially disposed within the crevice between opposing edges of the aperture or closure cover. This latter embodiment may be preferred in applications wherein suitable transmission and reception properties cannot be obtained with an antenna mounted within the crevice. In either case, the body of the deformable membrane may be at least partially coated on at least one side with an adhesive substance.

The conductive elements (antenna subunits, conductors, and transmission lines) and the protective membrane may be further encased in an external coating. This external coating may be included with the antenna assembly, or it may be added when the antenna assembly is installed or fixed in its final service location. The external coating substantially or completely seals the assembly against the intrusion of water or other fluids. It also serves to seal and protect the antenna cable to prevent water from entering the cable. The external coating is preferably an epoxy. For example, in a preferred embodiment, the external coating may be comprised of an epoxy, or of rubber or plastic, and may include an adhesive that serves to fixedly attach the antenna to a mounting surface. For permanent antenna assembly installations, an antenna assembly may be at least partially embedded within an adhesive or epoxy that at least partially fills the gap or crevice where the antenna assembly is at least partially installed, and may serve to seal the gap or crevice permanently against the intrusion of liquids, gasses, or other environmental hazards.

It should be noted that, while the above-described embodiment is a preferred embodiment, additional variations are possible. For example, a single antenna leg may be used, or more than two legs may be used, and the leg or legs may be positioned in a loop, a curve, or some orientation other than a straight line so long as the resulting antenna is deformable. The antenna legs, being made of conductive material, can take on a variety of constriction techniques to address cost, mounting techniques, and desired signal pattern. In addition, in an alternate embodiment, the protective covering is not included and the antenna legs are directly mounted to a mounting surface with only the external coating serving as both a protectant and an adhesive. Also optionally, the protective covering and the external coating may be integral with each other, or they may comprise the same item or material, such as for example a plastic or rubber having adhesive qualities. As an additional option, the protective covering and/or the external coating may be made of a material that partially or entirely degrades or disintegrates, thus leaving only one of the two materials to protect the antenna.

In one preferred embodiment, at least a portion of the protective membrane is ring shaped. More preferably, this ring-shaped portion is sized to fit around a periphery of an aperture or closure cover. Even more preferably, this ring-shaped portion is sized to fit around a periphery of a manhole cover. Owing to the deformable quality of the protective membrane, the ring-shaped portion of the membrane may be smaller than the circumference of an outer periphery of the aperture cover and may be stretched to fit around the outer periphery of the aperture or closure cover and, thus, may secure itself to the cover in a "rubber band" fashion, held in place by its own contractile force. Alternatively, or in addition, the ring-shaped portion may include an adhesive material to aid in securing the antenna assembly to the periphery of the aperture or closure cover.

One of the preferred embodiments described above is illustrated in FIG. 1. Referring to FIG. 1, an antenna assembly comprising a dipole antenna includes conductive elements 1 and 2 that serve as the antenna legs. Preferably, the conductive elements 1 and 2 are deformable and flexible to allow the elements to be positioned in various locations and to resist the stresses of the mounting location. The conductive elements 1 and 2 are made of a conductive material such as copper wire, copper mesh, copper weave, copper tape, or any other conductive material that may be molded or flattened and preferably has a low profile.

A conductor 3 is conductively connected to the antenna legs, preferably at or near the gap that separates the legs. The conductor preferably includes at least two conductors so that one conductor can be attached to the antenna leg that serves as ground and the other conductor can be attached to the antenna leg that is designated as positive. As FIG. 1 illustrates, the conductor may be positioned to extend from the legs in a direction that is perpendicular to the legs. A transmission line 4 is conductively connected to the conductor at the end of the conductor opposite to the connection with the antenna legs. The transmission line is, preferably, a standard coaxial cable.

The antenna, conductor, and transmission line are encased in a elastically deformable, non-conductive protective membrane 5. As noted above, the protective membrane may be made of rubber, plastic, or any other non-conductive but elastically deformable material. Although FIG. 1 illustrates an embodiment where the antenna and conductor are completely encased within the protective membrane, optionally the protective covering may cover only a portion of these elements, such as the top of the elements. Preferentially, the transmission line is enclosed within the protective membrane at its junction with the conductor and additionally to a distance sufficient to ensure secure, durable, and waterproof protection of that junction. Typically, about one to about three inches is sufficient, though more or less may be used as required.

Optionally and preferably, the conductive elements and/or the protective membrane may be further encased in or covered by an external coating. This external coating may be included with the antenna, or it may be added when the antenna is installed in its final service location. In a preferred embodiment, the external coating is comprised of an epoxy, or of rubber or plastic with an adhesive, that serves to fixedly attach the antenna to a mounting surface.

Figure 2:
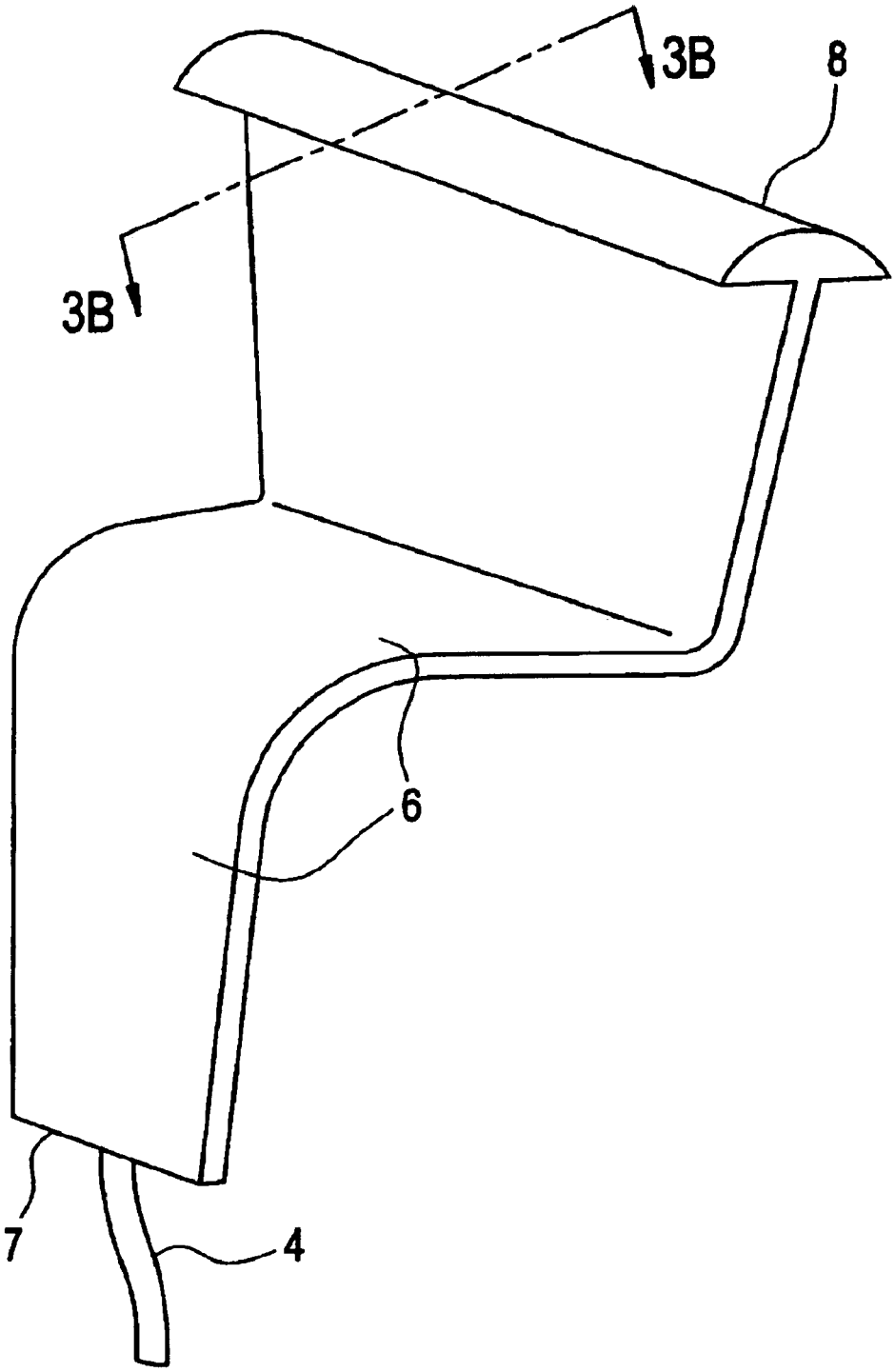
FIG. 2 provides a perspective external view illustrating several elements of a preferred embodiment of the present inventive antenna assembly.
Figure 3A:
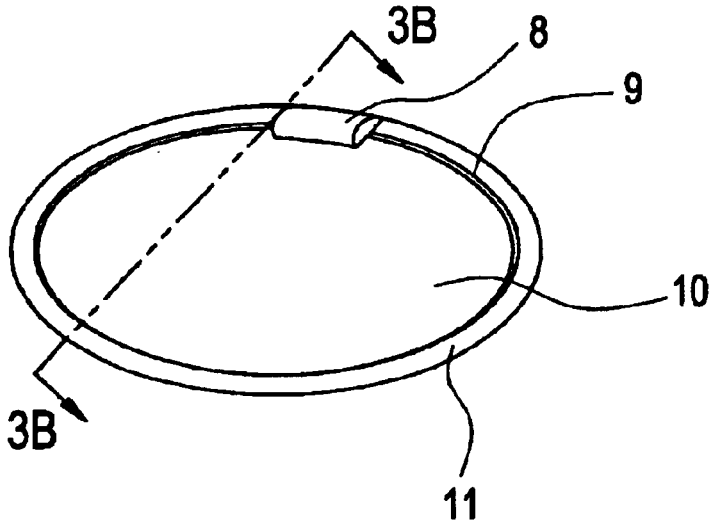
FIGS. 3A and 3B provide a cross sectional view illustrating several elements of the preferred embodiment of FIG. 2
Figure 3B:
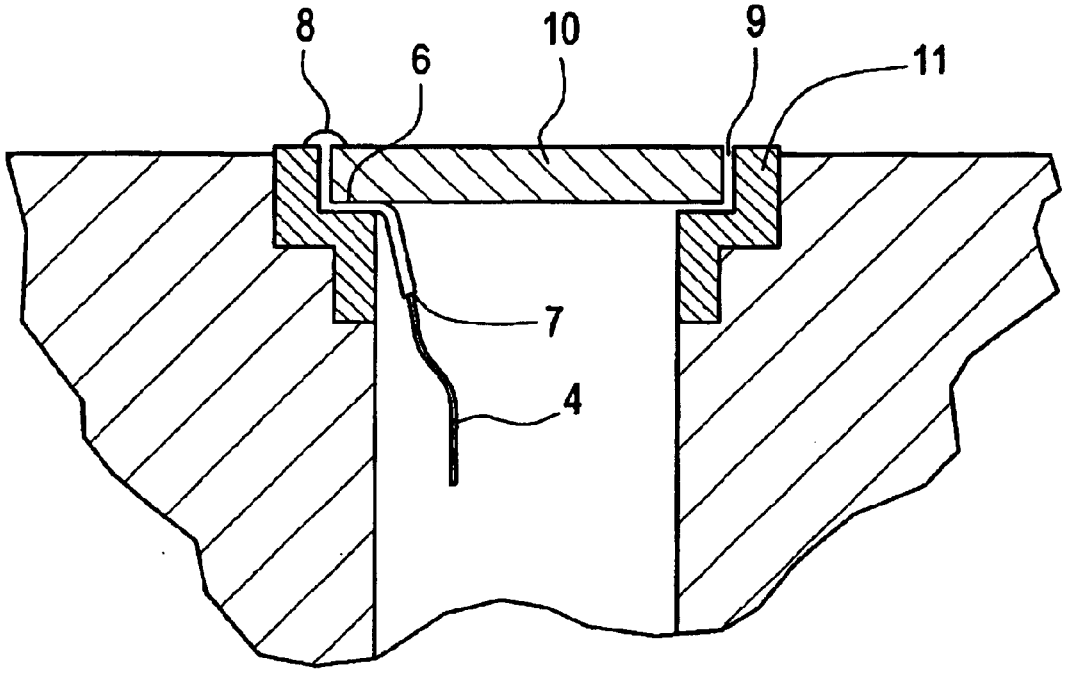

FIG. 2 provides a perspective view of another preferred embodiment wherein the deformable membrane has a substantially flat body 6 having a base edge 7 and a crest edge 8 opposite to the base edge, wherein the at least one transmission line emerges from the base edge of the deformable membrane, the at least one conductor is disposed within the body of the deformable membrane, and the at least one dipole antenna is at least partially enclosed within the crest edge of the deformable membrane, and the crest edge has a thicker cross section than the body of the deformable membrane. FIG. 3A shows the same embodiment in an installed or fixed configuration in a crevice 9 between a manhole cover 10 and a manhole ring 11 located in a roadway traffic surface. FIG. 3B shows the same installed embodiment in cross-section.

Figure 4:
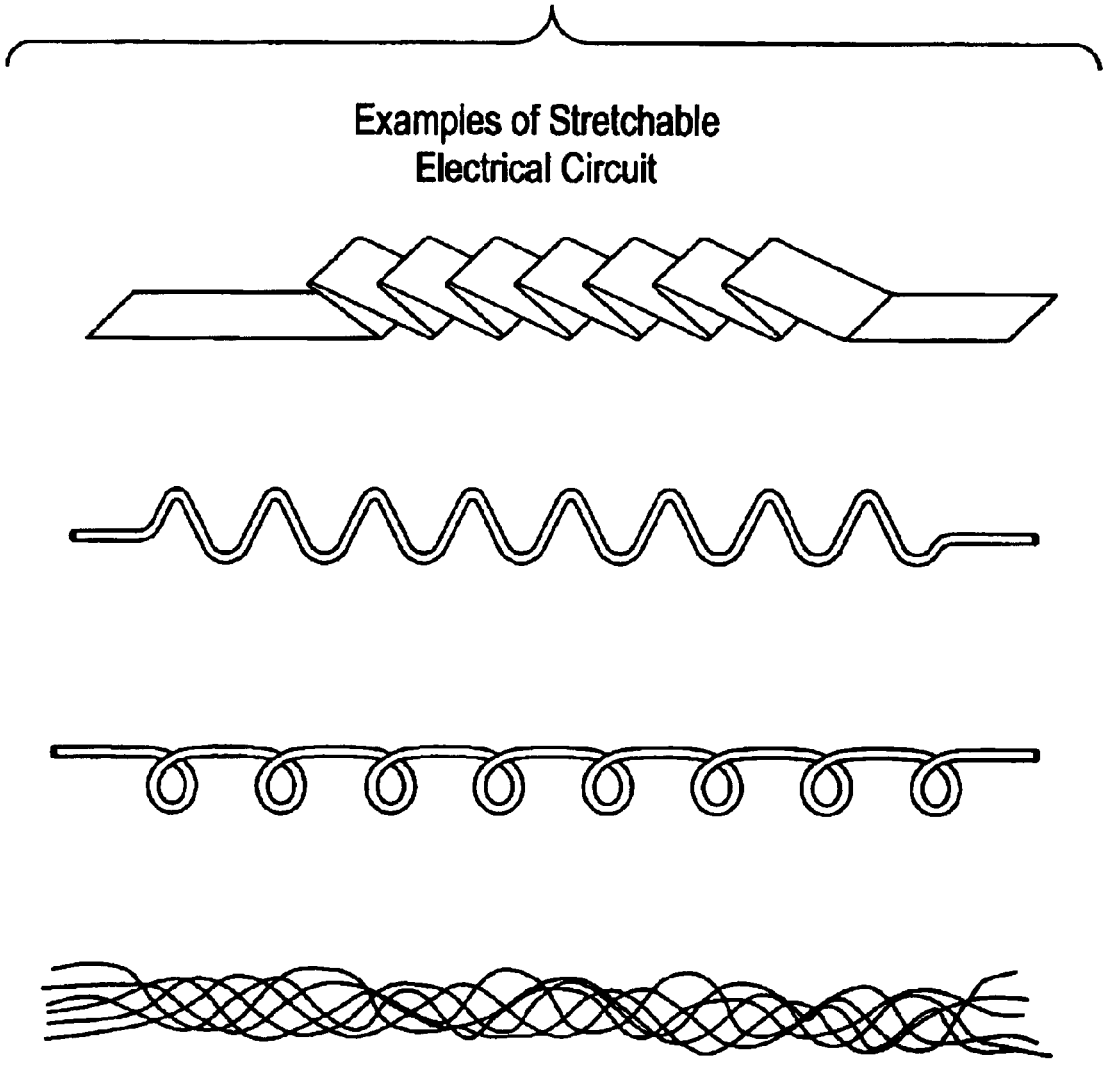
FIG. 4 shows detail of a portion of an embodiment of the present invention.

The antenna legs and conductor are made of a deformable material, such as copper wire, weave, mesh, or tape. FIG. 4 shows some configurations in which wire or tape, preferably copper wire or tape, may be made extensible and, therefore, increasingly deformable and resistant to mechanical stress. Such configurations include a coiled shape, a woven shape, a mesh shape, an undulating shape, and a repetitively folded shape.

Figure 5A:
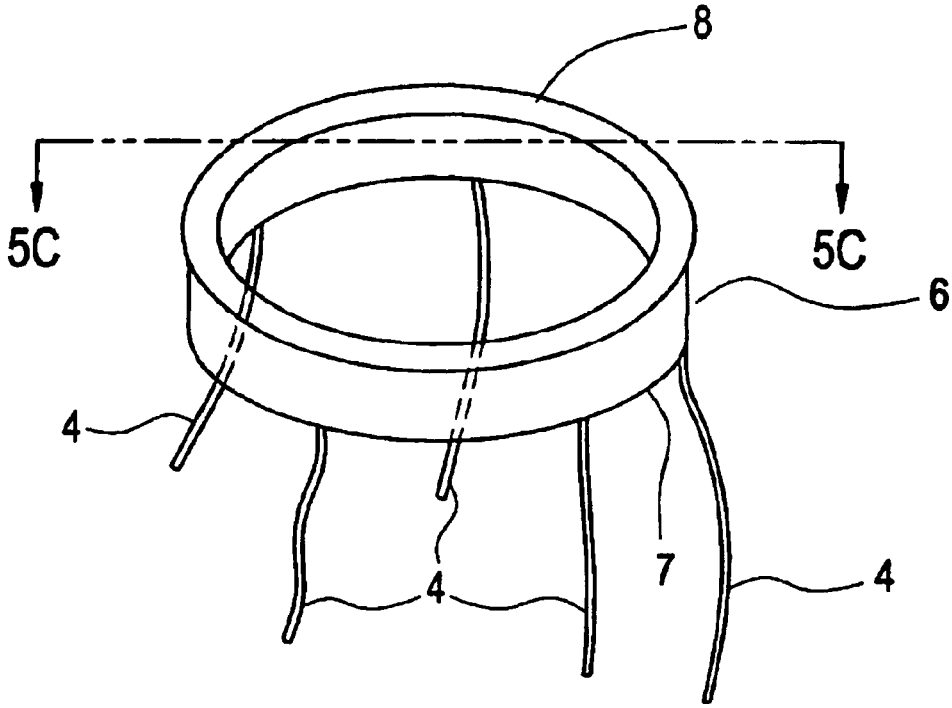
FIGS. 5A, 5B and 5C provide perspective external views illustrating several elements of an alternate embodiment of the present invention.
Figure 5B:
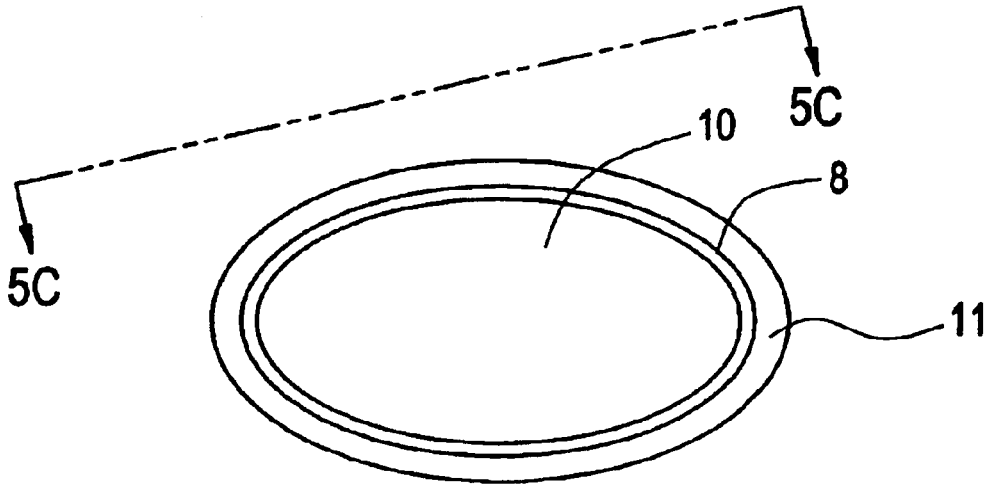
Figure 5C:
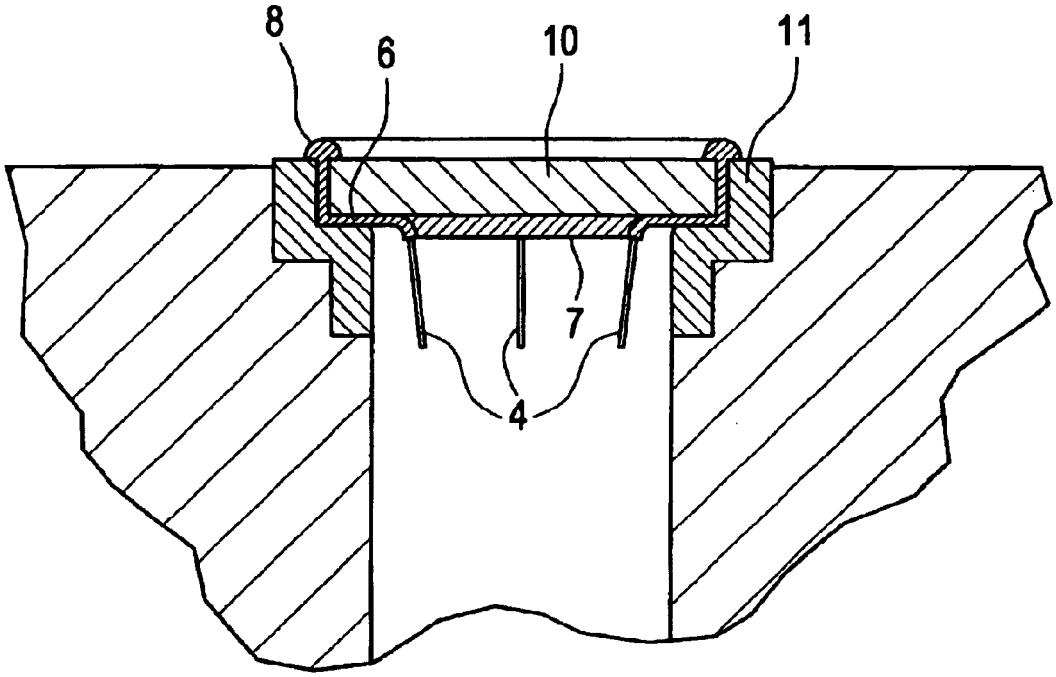

FIG. 5A shows an alternate embodiment, as described above, wherein at least a portion of the body of the protective membrane is ring shaped. In a more preferred embodiment, the ring-shaped portion is sized to fit around a periphery of an aperture or closure cover. FIG. 5B shows the same embodiment in an installed configuration in a perspective view. FIG. 5C shows the same embodiment in cross-section. In this embodiment, the portion of the body of the protective membrane that is ring shaped is sized to fit elastically around a periphery of an aperture cover, most preferably a manhole cover, and is thus secured to the periphery of the manhole cover by elastic contractile tension. The body of the deformable membrane is most preferably of sufficient length to entirely bridge the length of the crevice between opposing edges of the aperture, as shown in FIG. 5C. Also, in this embodiment, the antenna assembly includes multiple antenna subunits, as depicted by the plurality of transmission lines extending from the body of the membrane below the traffic surface. It should be noted, however, that a single transmission line might be used equally well. A preferred example of such a multiple-antenna transmission line would include a plurality of pairs of conducting wires, and a most preferred embodiment would have a number of pairs of conducting lines equal to the number of antennae included in the antenna assembly.

The final installation depends upon the embodiment of the present invention chosen to be installed or fixed, but generally consists of opening an openably closed aperture or closure, placing the antenna assembly adjacent to a mounting surface, a mounting surface preferably being one of the opposing edges of the closure and more preferably a periphery of a closure cover or surround, and closing the closure to fix the antenna assembly in place. "Fixing" means permanently or removably positioning an antenna assembly in a location such that the antenna assembly is held substantially immobile by opposing edges of the gap or crevice in which the antenna assembly is fixed. A fixed antenna assembly may or may not be pinched, clamped, squeezed, or otherwise compressed by the opposing edges. Prior to the closing step, final connection to a transceiver located within the enclosed system or network is preferably accomplished. For example, the transmitter/receiver may be mounted inside of a manhole, and the antenna may be installed in the crevice between a portion of the manhole cover and a portion of the manhole ring, as shown in FIG. 3A, or in the crevice around the entire periphery of the manhole cover, as shown in FIG. 5B or 5C. The at least one transmission line is also attached to the transmitter/receiver within the manhole. Preferably, a disconnect is included between the antenna and the transmitter/receiver to allow removal of the manhole cover without damaging the antenna assembly, the transmission line, or the transmitter/receiver.

In a particularly preferred embodiment, an antenna assembly of the present invention is installed as follows. The antenna assembly is installed in a traffic surface comprising a cover and a surround adapted to receive the cover in an orientation substantially flush with the traffic surface. The preferred embodiment of the antenna assembly includes at least one transmission line; at least one conductor for conductively connecting the at least one antenna to the at least one transmission line, wherein the at least one conductor is deformable; and a deformable membrane made from substantially non-conducting material substantially covering the at least one antenna and the at least one conductor, and at least partially enclosing the at least one transmission line; wherein the deformable membrane has a substantially flat body having a base edge and a crest edge opposite to the base edge; wherein the at least one transmission line emerges from the base edge of the deformable membrane, the at least one conductor is disposed within the body of the deformable membrane, and the at least one antenna is at least partially enclosed within the crest edge of the deformable membrane; and wherein the crest edge has a thicker cross section than the body of the deformable membrane. The antenna assembly is adhered using an adhesive substance coating at least part of one side of the body of the membrane to at least a portion of the outer periphery of the aperture cover so that the crest edge is disposed above the traffic surface of the aperture cover but no more than about ¼ inch above the traffic surface of the aperture cover, at least a portion of the body of the deformable membrane is disposed across the outer periphery of the cover, and the at least one cable extends below the cover. The cover is then replaced within the surround such that the at least a portion of the body of the deformable membrane is clamped between at least a portion of the outer periphery of the cover and the at least a portion of the inner periphery of the surround, and such that the crest edge is disposed above, but not more than about ¼ inch above, the traffic surface, and the at least one cable extends below the traffic surface. Most preferably, the at least one transmission line was connected to at least one transmitter/receiver below inside the enclosed system or network prior to closing the aperture.

An aperture or closure with an antenna assembly of the present invention installed or fixed between opposing edges of the closure is an apparatus in itself, and is within the scope of the present invention. A particularly preferred example of such an apparatus is a manhole cover and manhole ring with an antenna assembly of the present invention, as described above, fixed within the crevice between the outer periphery of the manhole cover and the inner periphery of the manhole ring.

Optionally and alternatively, the antenna may be mounted on a surface other than a manhole surface, such as on a roadway, or even partially or completely embedded within and/or flush with the surface, such as in concrete, asphalt, other pavement, or even a floor, wall, or air duct that has a gap, crevice, aperture, or closure. In such an embodiment, the at least one transmission line may be run to the aperture or closure cover to be passed through a hole, or it may enter the enclosed system through a gap, crevice, or hole in the side or a location other than the cover. It may also be passed through other locations, such as storm sewer grates, tire or track grooves, irrigation system recesses, or other locations. In such configurations, the transmission line may run along a surface, or it may be positioned within a groove, a trench, a conduit, a gap, a crevice, or another enclosed or partially enclosed location.

The construction of the antenna as a dipole provides two "legs," or antenna elements, having substantially equal lengths and extending in opposite directions from a central point. Prior art dipole antennas generally must be mounted a distance, typically one-half-wavelength or more above the ground. This antenna, however, is specially tuned to optimize performance in a low profile configuration. Specifically, the leg lengths are specially tuned to compensate for the antenna's close proximity to other construction features. Preferably, in an embodiment of this invention where the frequency of the transmitter is consistent with that of a wireless telephone, the overall combined length of the legs is between about six-and-one-half and about seven-and-one-half inches. Surprisingly and advantageously, we have found that such a length yields satisfactory results when the antenna is on or flush with a surface. This also satisfies the antenna impedance requirements for the connected transmitter and/or receiver.

The deformability of the antenna assembly, including the antenna elements, allows unique mounting opportunities. When mounted to a flat surface, it provides for a low profile above the flat surface, helping to make the antenna resistant to damage from objects moving across the surface. When mounted on a textured surface it may be oriented to utilize any surface pattern which will allow the antenna to conform to surface recesses, thus making it low in height relative to the surface to which it is attached. Preferably, the height of the antenna is no greater than about one-quarter inch, although antennas having greater height may be used so long as the overall profile above ground is low or non-existent.

The present invention also allows for the use of an antenna assembly having more than one antenna element, preferably more than one dipole element. In this optional configuration, each dipole element would be mounted side-by-side, substantially in parallel with a space between each dipole element. The dipole elements are each comprised of two "legs" but may be of different lengths, widths, and/or thicknesses to provide multiple transmission and/or reception frequencies. For example, a configuration may include a dipole element used for transmission on one frequency and a second dipole element used for reception on another frequency. Preferably, the multiple dipole elements are encased within a common protective membrane and/or external coating. Also preferably, the external appearance of such a configuration is not substantially different from the appearance of an embodiment using only a single dipole or other type of antenna. As noted above, an antenna assembly of the present invention may include multiple antennae of different types.

The deformability and low profile of the present inventive antenna thus reduce or eliminate the susceptibility for damage of the antenna resulting from roadway traffic. For example, the present inventive antenna is non susceptible to damage from snow plows, street sweepers, and other such equipment that abrade the road surface. The antenna design is also such that, when installed in locations such as manhole covers, the antenna is nearly invisible to the pedestrian, thus making it less susceptible to vandalism. Further, low profile of the present inventive antenna reduces or eliminates the susceptibility for injury to pedestrians coming into contact with the antenna. The low profile makes it very unlikely that a pedestrian would trip over or catch his or her foot or clothing on the antenna. Thus, the present invention is useful for applications requiring the placement of an antenna in high foot-traffic areas, such as sidewalks, floors, decking, hallways and stairways, or confined areas such as crawl-spaces where clothing is likely to be caught on protruding objects.

Another improvement offered by this invention is the ease of installation. Through the use of fast curing adhesives or encapsulate materials, the antenna can be placed on the aperture or closure cover, or within the crevice between such a cover and its surround, and secured within a short period of time with minimal skill or tools required to complete the process. Optionally and preferably, no bolting or welding is required, and the antenna assembly is held in place by the pressure exerted upon it by the opposing edges of the closed aperture. Installation is further eased in embodiments having a partial or complete coating of adhesive material on one side of the protective membrane. By adhering the antenna assembly to an opposing edge of the closure, preferably to an closure cover or surround, prior to closing the closure to fix the antenna assembly in place, the risk of dropping or otherwise misaligning the antenna assembly during installation is substantially decreased, and the likelihood of proper installation on the first attempt is increased. This design produces an antenna that is relatively inexpensive when compared to conventional antenna designs that rely more fully on mechanical mounting means and mechanical structure to make the antenna durable to roadway conditions.

This invention also permits mounting of the antenna on a manhole cover, or directly on or in the roadway with minimal excavation, to route the antenna wire or achieve a suitable cavity into which the antenna is secured using suitable adhesives or filler materials. Because the antenna is not totally rigid prior to installation, it offers flexibility during the installation process, even when installation conditions are less than ideal.

The antenna assembly offers several opportunities and uses for delivery of data signals to or from the transceiver to which it is connected. "Transceiver" means any instrument capable of transmitting or receiving electrical signals, or both. In one embodiment, the installed antenna assembly, as described above, may be connected to a flow meter located within a sewer network, and the antenna assembly could electrically transmit the data collected by the flow meter to a receiver such as a central data collection point, a mobile receiver such as a receiver mounted in a vehicle, or even a hand-held receiver. Even further, an embodiment of the present invention including a plurality of antenna subunits within one antenna assembly may transmit several signals simultaneously from several sensors to one or more receivers, as noted above. The plurality of antennae may act independently or cooperatively to transmit the same or different signals to one or more receivers at one or more RF frequencies. Preferably, the transceiver or other instrument is located behind a closure or below a traffic surface.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, all of which may fall within the scope of the invention.

What is claimed is:

1. An antenna assembly, comprising:

at least one antenna;

at least one transmission line;

at least one conductor for conductively connecting the at least one antenna to the at least one transmission line, wherein the conductor is deformable; and a deformable membrane made from substantially non-conducting material, wherein the deformable membrane substantially encloses the at least one antenna and the at least one conductor, and at least partially encloses the at least one transmission line;

wherein the at least one conductor comprises a conductive solid material; and wherein the conductive solid material is a wire; and wherein the wire is repetitively folded.

2. An antenna assembly, comprising:

at least one antenna;

at least one transmission line;

at least one conductor for conductively connecting the at least one antenna to the at least one transmission line, wherein the conductor is deformable; and a deformable membrane made from substantially non-conducting material, wherein the deformable membrane substantially encloses the at least one antenna and the at least one conductor, and at least partially encloses the at least one transmission line;

wherein the at least one conductor comprises a conductive solid material; and wherein the conductive solid material is a wire; and wherein the wire has an undulating shape.

3. An antenna assembly, comprising:

at least one antenna;

at least one transmission line;

at least one conductor for conductively connecting the at least one antenna to the at least one transmission line, wherein the conductor is deformable; and a deformable membrane made from substantially non-conducting material, wherein the deformable membrane substantially encloses the at least one antenna and the at least one conductor, and at least partially encloses the at least one transmission line;

wherein the at least one conductor comprises a conductive solid material; and wherein the conductive solid material is a ribbon.

4. The antenna assembly of claim 3 wherein the ribbon is repetitively folded.

5. The antenna assembly of claim 3, wherein the ribbon has an undulating shape.

6. An antenna assembly, comprising:

at least one antenna;

at least one transmission line;

at least one conductor for conductively connecting the at least one antenna to the at least one transmission line, wherein the conductor is deformable; and a deformable membrane made from substantially non-conducting material wherein the deformable membrane substantially encloses the at least one antenna and the at least one conductor, and at least partially encloses the at least one transmission line;

wherein the deformable membrane has a substantially flat body having a base edge and a crest edge opposite to the base edge, wherein the at least one transmission line emerges from the base edge of the deformable membrane, the at least one conductor is disposed within the body of the deformable membrane, and the at least one dipole antenna is at least partially enclosed within the crest edge of the deformable membrane.

7. The antenna assembly of claim 6, wherein the crest edge has a thicker cross section than the body of the deformable membrane.

8. The antenna assembly of claim 7, wherein the body of the deformable membrane is at least partially coated on at least one side with an adhesive substance.

9. The antenna assembly of claim 7, wherein the body of the deformable membrane is ring-shaped and is sized to elastically encircle a periphery of a traffic surface cover.

10. The antenna assembly of claim 8, wherein the body of the deformable membrane is ring-shaped and is sized to elastically encircle a periphery of a traffic surface cover.

11. An antenna assembly, comprising:

at least one antenna;

at least one transmission line;

at least one conductor for conductively connecting the at least one antenna to the at least one transmission line, wherein the conductor is deformable; and a deformable membrane made from substantially non-conducting material, wherein the deformable membrane substantially encloses the at least one antenna and the at least one conductor, and at least partially encloses the at least one transmission line;

wherein at least part of the deformable membrane is ring-shaped and is sized to elastically encircle a periphery of a traffic surface cover.

12. An antenna assembly, comprising:

at least one antenna;

at least one transmission line;

at least one conductor for conductively connecting the at least one antenna to the at least one transmission line, wherein the conductor is deformable; and a deformable membrane made from substantially non-conducting material, wherein the deformable membrane substantially encloses the at least one antenna and the at least one conductor, and at least partially encloses the at least one transmission line;

wherein the deformable membrane is at least partially coated on at least one side with an adhesive substance; and wherein at least part of the deformable membrane is ring-shaped and is sized to elastically encircle a periphery of a traffic surface cover.

13. A method of fixing an antenna assembly in a gap, comprising:

disposing within a gap at least a portion of an antenna assembly, the antenna assembly comprising:

at least one antenna;

at least one transmission line;

at least one conductor for conductively connecting the at least one antenna to the at least one transmission line, wherein the conductor is deformable; and a deformable membrane made from substantially non-conducting material substantially covering the at least one antenna, the at least one conductor, and at least partially encloses the at least one transmission line; and fixing the antenna assembly in place in the gap.

14. The method of claim 13, wherein the gap is a gap in a closure, and wherein said method further comprises:

opening the closure sufficiently to provide a gap;

disposing within the gap at least a portion of an antenna assembly; and closing the closure to fix the antenna assembly in place.

15. The method of claim 14, wherein the closure comprises a traffic surface, comprising:

a cover and a surround adapted to receive the cover in an orientation substantially flush with the traffic surface; and wherein the method comprises:

removing the cover from within the surround;

disposing adjacent to at least a portion of an inner periphery of the surround at least a portion of an antenna assembly; and replacing the cover within the surround such that the at least a portion of the antenna assembly is fixed between at least a portion of the cover and the at least a portion of the inner periphery of the surround.

16. The method of claim 15, wherein the deformable membrane is at least partially coated on at least one side with an adhesive substance; and wherein the method comprises:

adhering at least a portion of the antenna assembly to either at least a portion of an outer periphery of the cover or at least a portion of an inner periphery of the surround; and replacing the cover within the surround such that the at least a portion of the antenna assembly is fixed between at least a portion of the cover and at least a portion of the inner periphery of the surround.

17. The method of claim 16, wherein the at least one antenna is a dipole antenna.

18. The method of claim 17, wherein the at least one dipole antenna comprises first and second elongated elements separated by a gap, and the first and second elongated elements are positioned to extend in substantially opposite directions from one another and to form a substantially straight line; and wherein the substantially straight line has a length that corresponds to an operating frequency band of the at least one antenna.

19. The method of claim 18, wherein the length provides an electrically tuned antenna that is configured to transmit and receive RF signals in close proximity to a surface.

20. The method of claim 15, wherein the deformable membrane has a substantially flat body having a base edge and a crest edge opposite to the base edge;

wherein the at least one transmission line emerges from the base edge of the deformable membrane, the at least one conductor is disposed within the body of the deformable membrane, and the at least one antenna is at least partially enclosed within the crest edge of the deformable membrane; and wherein the crest edge has a thicker cross section than the body of the deformable membrane; and wherein the method comprises:

disposing adjacent to at least a portion of an inner periphery of the surround at least a portion of the antenna assembly so that the crest edge is disposed above the traffic surface but no more than about ¼ inch above the traffic surface, at least a portion of the body of the deformable membrane is disposed across the inner periphery of the surround, and the at least one cable extends below the surround; and replacing the cover within the surround such that the at least a portion of the body of the deformable membrane is fixed between at least a portion of the outer periphery of the cover and the at least a portion of the inner periphery of the surround, and such that the crest edge is disposed above, but not more than about ¼ inch above, the traffic surface, and the at least one cable extends below the traffic surface.

21. The method of claim 20, wherein the body of the deformable membrane is at least partially coated on at least one side with an adhesive substance; and wherein the method comprises:

adhering at least a portion of the body of the deformable membrane of the antenna assembly to at least a portion of an outer periphery of the cover or an inner periphery of the surround so that the crest edge is disposed above the traffic surface but no more than about ¼ inch above the traffic surface, the at least a portion of the body of the deformable membrane is disposed across the outer periphery of the cover or the inner periphery of the surround, and the at least one transmission line extends below the cover or surround; and replacing the cover within the surround such that the at least a portion of the body of the deformable membrane is fixed between the at least a portion of the outer periphery of the cover and at least a portion of the inner periphery of the surround or the at least a portion of the inner periphery of the surround and at least a portion of the outer periphery of the cover, such that the crest edge is disposed above, but not more than about ¼ inch above, the traffic surface, and the at least one cable extends below the traffic surface.

22. The method of claim 21, wherein the cover is a manhole cover and the surround is a manhole ring.

23. The method of claim 15, wherein at least part of the deformable membrane is ring shaped and is sized to elastically encircle the periphery of the traffic surface cover; and wherein the method comprises:

disposing around an outer periphery of the cover at least a portion of the antenna assembly; and replacing the cover within the surround such that the at least a portion of the antenna assembly is fixed between the outer periphery of the cover and at least a portion of the inner periphery of the surround.

24. The method of claim 23, wherein the at least part of the deformable membrane that is ring shaped is sized to elastically encircle the periphery of the traffic surface cover and is at least partially coated on at least one side with an adhesive substance; and wherein the method comprises:

adhering to an outer periphery of the cover at least a portion of the antenna assembly; and replacing the cover within the surround such that the at least a portion of the antenna assembly is fixed between the outer periphery of the cover and at least a portion of the inner periphery of the surround.

25. The method of claim 23, wherein the deformable membrane has a substantially flat body having a base edge and a crest edge opposite to the base edge;

wherein the at least one transmission line emerges from the base edge of the deformable membrane; the at least one conductor is disposed within the body of the deformable membrane; and the at least one antenna is at least partially enclosed within the crest edge of the deformable membrane;

wherein the crest edge has a thicker cross section than the body of the deformable membrane; and wherein at least part of the body of the deformable membrane is ring shaped and is sized to elastically encircle the outer periphery of the traffic surface cover; such that the crest edge is disposed above, but not more than about ¼ inch above, the traffic surface cover, and the at least one transmission line extends below the cover; and wherein the method comprises:

disposing around an outer periphery of the cover at least a portion of the antenna assembly; and replacing the cover within the surround such that the at least a portion of the body of the deformable membrane is fixed between the at least a portion of the outer periphery of the cover and at least a portion of the inner periphery of the surround, such that the crest edge is disposed above, but not more than about ¼ inch above, the traffic surface, and the at least one transmission line extends below the traffic surface.

26. The method of claim 25, wherein the at least part of the deformable membrane is ring shaped is at least partially coated on at least one side with an adhesive substance; and wherein the method comprises:

adhering to an outer periphery of the cover at least a portion of an antenna assembly, the antenna assembly comprising; and replacing the cover within the surround such that the at least a portion of the body of the deformable membrane is fixed between the at least a portion of the outer periphery of the cover and at least a portion of the inner periphery of the surround, such that the crest edge is disposed above, but not more than about ¼ inch above, the traffic surface, and the at least one transmission line extends below the traffic surface.

27. The method of claim 26, wherein the cover is a manhole cover and the surround is a manhole ring.

28. The method of claim 26, wherein the at least one antenna is a dipole antenna.

29. The method of claim 28, wherein the at least one dipole antenna comprises first and second elongated elements separated by a gap, and the first and second elongated elements are positioned to extend in substantially opposite directions from one another and to form a substantially straight line; and wherein the substantially straight line has a length that corresponds to an operating frequency band of the at least one antenna.

30. The method of claim 29, wherein the length provides an electrically tuned antenna that is configured to transmit and receive RF signals in close proximity to a surface.

31. The antenna assembly of claim 28, wherein the at least one dipole antenna comprises first and second elongated elements separated by a gap, and the first and second elongated elements are positioned to extend in substantially opposite directions from one another and to form a circumferentially-curving line;

wherein the circumferentially-curving line has a length that corresponds to an operating frequency band of the at least one antenna; and wherein the length provides an electrically tuned antenna that is configured to transmit and receive RF signals in close proximity to a surface.

32. The method of claim 13, wherein the gap is a gap in a solid surface.

33. The method of claim 32, wherein the gap in a solid surface is a gap between bricks or stones in masonry.

34. The method of claim 33, wherein the deformable membrane has a substantially flat body having a base edge and a crest edge opposite to the base edge;

wherein the at least one transmission line emerges from the base edge of the deformable membrane; the at least one conductor is disposed within the body of the deformable membrane; and the at least one antenna is at least partially enclosed within the crest edge of the deformable membrane;

wherein the crest edge has a thicker cross section than the body of the deformable membrane;

wherein the at least one transmission line is disposed behind the solid surface and the at least one antenna is disposed about flush with or no more than about ¼ inch above the solid surface; and wherein the antenna assembly is fixed between the stones or bricks of the masonry.

35. The method of claim 32, wherein the gap in a solid surface is a groove cut into the surface.

36. The method of claim 35, wherein the deformable membrane has a substantially flat body having a base edge and a crest edge opposite to the base edge;

wherein the at least one transmission line emerges from the base edge of the deformable membrane; the at least one conductor is disposed within the body of the deformable membrane; and the at least one antenna is at least partially enclosed within the crest edge of the deformable membrane;

wherein the crest edge has a thicker cross section than the body of the deformable membrane;

wherein the at least one transmission line is disposed behind the solid surface and the at least one antenna is disposed about flush with or no more than about ¼ inch above the solid surface; and wherein at least a portion of the deformable membrane is fixed between opposing edges of the groove.

37. An antenna assembly, comprising:

at least one antenna;

at least one transmission line;

at least one conductor for conductively connecting the at least one antenna to the at least one transmission line, wherein the conductor is deformable; and a deformable membrane made from substantially non-conducting material, wherein the deformable membrane substantially encloses the at least one antenna and the at least one conductor, and at least partially encloses the at least one transmission line;

wherein the at least one antenna is a dipole antenna; and wherein the at least one dipole antenna comprises first and second elongated elements separated by a gap, and the first and second elongated elements are positioned to extend in substantially opposite directions from one another and to form a circumferentially-curving line.

38. The antenna assembly of claim 37, wherein the circumferentially-curving line has a length that corresponds to an operating frequency band of the at least one antenna.

39. The antenna assembly of claim 38, wherein the length provides an electrically tuned antenna that is configured to transmit and receive RF signals in close proximity to a surface.

40. An apparatus, comprising:

an antenna assembly fixed within a gap, the antenna assembly comprising:

at least one antenna;

at least one transmission line;

at least one conductor for conductively connecting the at least one antenna to the at least one transmission line, wherein the conductor is deformable; and a deformable membrane made from substantially non-conducting material substantially enclosing the at least one antenna and the at least one conductor, and at least partially enclosing the at least one transmission line;

wherein the gap is a gap in a closure; and wherein the closure comprises:

a traffic surface comprising a cover and a surround adapted to receive the cover in an orientation substantially flush with the traffic surface; and the antenna assembly is fixed between at least part of an outer periphery of the cover and at least part of an inner periphery of the surround.

41. The apparatus of claim 40, where in the cover is a manhole cover and the surround is a manhole ring.

42. The apparatus of claim 41, wherein the deformable membrane has a substantially flat body having a base edge and a crest edge opposite to the base edge;

wherein the at least one transmission line emerges from the base edge of the deformable membrane, the at least one conductor is disposed within the body of the deformable membrane, and the at least one antenna is at least partially enclosed within the crest edge of the deformable membrane; and wherein the crest edge has a thicker cross section than the body of the deformable membrane; and wherein the crest edge is disposed above the traffic surface but no more than about ¼ inch above the traffic surface, at least a portion of the body of the deformable membrane is disposed between the at least part of the outer periphery of the cover and the at least part of the inner periphery of the surround, and the at least one transmission line extends below the traffic surface.

43. The apparatus of claim 42, wherein the cover is a manhole cover and the surround is a manhole ring.

44. A method for sending and receiving RF signals, comprising:

providing an antenna assembly at least partially fixed within at least a portion of a gap, wherein the antenna assembly comprises:

at least one conductor wherein the at least one conductor is deformable; and a deformable membrane made from substantially non-conducting material substantially covering the at least one conductor;

providing at least one RF signal transceiver;

connecting conductively the at least one RF signal transceiver to the at least one antenna assembly; and transmitting or receiving RF signals using the antenna assembly;

wherein said gap is a gap in a closure; and wherein said closure comprises a traffic surface comprising:

a cover and a surround adapted to receive the cover in an orientation substantially flush with the traffic surface; and wherein said antenna assembly further comprises:

at least one antenna;

at least one transmission line; and wherein the conductor conductively connects the transmission line to the antenna;

wherein the deformable membrane made from substantially non-conducting material substantially encloses the at least one antenna and at least partially encloses the at least one transmission line;

wherein the at least one transmission line is disposed below the traffic surface and the at least one antenna is disposed about flush with or no more than about ¼ inch above the traffic surface; and wherein the antenna assembly is fixed between at least part of an outer periphery of the cover and at least part of an inner periphery of the surround; and wherein the at least one RF signal transceiver is connected conductively to the at least one antenna by conductively connecting the at least one RF signal transceiver to the at least one transmission line.

45. The method of claim 44, wherein the cover is a manhole cover and the surround is a manhole ring.

46. The method of claim 44, wherein the deformable membrane has a substantially flat body having a base edge and a crest edge opposite to the base edge;

wherein the at least one transmission line emerges from the base edge of the deformable membrane; the at least one conductor is disposed within the body of the deformable membrane; and the at least one antenna is at least partially enclosed within the crest edge of the deformable membrane;

wherein the crest edge has a thicker cross section than the body of the deformable membrane;

wherein the at least one transmission line is disposed below the traffic surface and the crest edge is disposed no more than about ¼ inch above the traffic surface.

47. The method of claim 44, wherein the antenna assembly comprises at least one dipole antenna; and wherein the at least one dipole antenna comprises first and second elongated elements separated by a gap, and the first and second elongated elements are positioned to extend in substantially opposite directions from one another and to form a substantially straight line.

48. The method of claim 47, wherein the substantially straight line has a length that corresponds to an operating frequency band of the at least one antenna.

49. The method of claim 48, wherein the length provides an electrically tuned antenna that is configured to transmit and receive RF signals in close proximity to a surface.

50. The method of claim 49, wherein the transceiver is below the traffic surface.

51. The method of claim 44 wherein the antenna assembly comprises at least one dipole antenna; and wherein the at least one dipole antenna comprises first and second elongated elements separated by a gap, and the first and second elongated elements are positioned to extend in substantially opposite directions from one another and to form a circumferentially-curving line.

52. The method of claim 51, wherein the circumferentially-curving line has a length that corresponds to an operating frequency band of the at least one antenna.

53. The method of claim 52, wherein the length provides an electrically tuned antenna that is configured to transmit and receive RF signals in close proximity to a surface.

54. A method for sending and receiving RF signals, comprising:

providing an antenna assembly at least partially fixed within at least a portion of a gap, wherein the antenna assembly comprises:

at least one conductor wherein the at least one conductor is deformable; and a deformable membrane made from substantially non-conducting material substantially covering the at least one conductor;

providing at least one RF signal transceiver;

connecting conductively the at least one RF signal transceiver to the at least one antenna assembly; and transmitting or receiving RF signals using the antenna assembly;

wherein said gap is a gap in a closure; and wherein the transceiver is behind the closure and the antenna assembly has a low profile in front of the closure.

55. An apparatus, comprising:

an antenna assembly fixed within a gap, the antenna assembly comprising:

at least one antenna;

at least one transmission line;

at least one conductor for conductively connecting the at least one antenna to the at least one transmission line, wherein the conductor is deformable; and a deformable membrane made from substantially non-conducting material substantially enclosing the at least one antenna and the at least one conductor, and at least partially enclosing the at least one transmission line;

wherein the gap is a gap in a solid surface; and wherein the gap in a solid surface is a gap between bricks or stones in masonry.

56. An apparatus, comprising:

an antenna assembly fixed within a gap, the antenna assembly comprising:

at least one antenna;

at least one transmission line;

at least one conductor for conductively connecting the at least one antenna to the at least one transmission line, wherein the conductor is deformable; and a deformable membrane made from substantially non-conducting material substantially enclosing the at least one antenna and the at least one conductor, and at least partially enclosing the at least one transmission line;

wherein the gap is a gap in a solid surface; and wherein the gap in a solid surface is a groove cut into the surface.

57. A method for sending and receiving RF signals, comprising:

providing an antenna assembly at least partially fixed within at least a portion of a gap, wherein the antenna assembly comprises:

at least one conductor wherein the at least one conductor is deformable; and a deformable membrane made from substantially non-conducting material substantially covering the at least one conductor;

providing at least one RF signal transceiver;

connecting conductively the at least one RF signal transceiver to the at least one antenna assembly; and transmitting or receiving RF signals using the antenna assembly;

wherein the gap is a gap in a solid surface; and wherein the gap in a solid surface is a gap between bricks or stones in masonry.

58. A method for sending and receiving RF signals, comprising:

providing an antenna assembly at least partially fixed within at least a portion of a gap, wherein the antenna assembly comprises:

at least one conductor wherein the at least one conductor is deformable; and a deformable membrane made from substantially non-conducting material substantially covering the at least one conductor;

providing at least one RF signal transceiver;

connecting conductively the at least one RF signal transceiver to the at least one antenna assembly; and transmitting or receiving RF signals using the antenna assembly;

wherein the gap is a gap in a solid surface; and wherein the gap in a solid surface is a groove cut into the surface.

59. An antenna assembly, comprising:

at least one antenna;

at least one transmission line;

at least one conductor for conductively connecting the at least one antenna to the at least one transmission line, wherein the conductor is deformable; and a deformable membrane made from substantially non-conducting material, wherein the deformable membrane substantially encloses the at least one antenna and the at least one conductor, and at least partially encloses the at least one transmission line; and further comprising at least one transceiver substantially enclosed within the deformable membrane and conductively connected with the at least one antenna.

* * * * *